US009869968B2

(12) United States Patent
Nagamori et al.

(10) Patent No.: US 9,869,968 B2
(45) Date of Patent: Jan. 16, 2018

(54) BLOWING TUBE, BLOWING DEVICE, AND IMAGE FORMING APPARATUS

(71) Applicant: FUJI XEROX CO., LTD., Tokyo (JP)

(72) Inventors: Yuki Nagamori, Ebina (JP); Yasunori Momomura, Ashigarakami-gun (JP); Masafumi Kudo, Ashigarakami-gun (JP); Yu Tsuda, Ebina (JP); Yasunori Unagida, Ebina (JP); Mihoko Tanaka, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/235,577

(22) Filed: Aug. 12, 2016

(65) Prior Publication Data

US 2017/0277121 A1 Sep. 28, 2017

(30) Foreign Application Priority Data

Mar. 28, 2016 (JP) ..... 2016-064348

(51) Int. Cl.
*G03G 21/20* (2006.01)
*G03G 15/02* (2006.01)

(52) U.S. Cl.
CPC ..... *G03G 21/206* (2013.01); *G03G 15/0258* (2013.01); *G03G 2221/1645* (2013.01)

(58) Field of Classification Search
CPC ..... G03G 21/206; G03G 15/0258; G03G 2221/1645
See application file for complete search history.

(56) References Cited

U.S. PATENT DOCUMENTS 1,503,371 A * 7/1924 Meyer ..... F02M 1/00 123/585
7,367,329 B2 * 5/2008 Yamamoto ..... F01L 3/205 123/590
8,965,238 B2 * 2/2015 Yamamoto ..... G03G 15/0291 399/100
8,997,721 B2 * 4/2015 Yamamoto ..... F02M 69/00 123/306
9,097,169 B2 * 8/2015 Logan ..... F01P 9/00
9,557,709 B1 * 1/2017 Momomura ..... G03G 21/206
2001/0026703 A1 * 10/2001 Kushida ..... G03G 21/206 399/93
2011/0121510 A1 * 5/2011 Tsuda ..... G03G 15/0258 271/226

(Continued)

FOREIGN PATENT DOCUMENTS

JP 2013-088731 A 5/2013

*Primary Examiner* — Ryan Walsh
(74) *Attorney, Agent, or Firm* — Oliff PLC

(57) ABSTRACT

There is provided blowing tube. A plurality of flow control members are provided in portions of a passage space of a passage portion which are positioned at different positions in an airflow direction, and control a flow of air. One of the flow control members is provided as a downstream-most flow control member such that the outlet port is blocked by a multi-hole member having a plurality of air holes. Each of the air holes of the downstream-most flow control member is configured as a through hole such that the opening area of the through hole decreases continuously or in a stepwisely toward the downstream side in an air passing direction.

4 Claims, 18 Drawing Sheets

(56) References Cited

U.S. PATENT DOCUMENTS

| | | | | |
|---|---|---|---|---|
| 2013/0086876 | A1* | 4/2013 | Ikeda | G01N 15/0255 55/418 |
| 2013/0101309 | A1 | 4/2013 | Inami et al. | |
| 2013/0108307 | A1* | 5/2013 | Katahira | G03G 21/206 399/92 |
| 2014/0119767 | A1* | 5/2014 | Inami | G03G 15/0291 399/92 |
| 2014/0169832 | A1* | 6/2014 | Nagamori | G03G 15/0291 399/172 |
| 2015/0110518 | A1* | 4/2015 | Nagamori | G03G 21/206 399/92 |

* cited by examiner

BLOWING TUBE, BLOWING DEVICE, AND IMAGE FORMING APPARATUS

CROSS-REFERENCE TO RELATED APPLICATIONS

This application is based on and claims priority under 35 U.S.C. §119 from Japanese Patent Application No. 2016-064348 filed on Mar. 28, 2016.

TECHNICAL FIELD

The present invention relates to a blowing tube, a blowing device, and an image forming apparatus.

SUMMARY

According to an aspect of the embodiments of the present invention, there is provided a blowing tube including: a passage portion that includes a passage space through which an inlet port taking in air is connected to an outlet port that outputs the air taken in by the inlet port and has an opening shape which is long in the one direction, and through which air flows; and plural flow control members that are provided in portions of the passage space of the passage portion which are positioned at different positions in an airflow direction, and that control a flow of air, wherein one of the plural flow control members is provided as a downstream-most flow control member such that the outlet port is blocked by a multi-hole member having plural air holes, and wherein each of the plural air holes of the downstream-most flow control member is configured as a through hole such that the opening area of the through hole decreases continuously or in a stepwisely toward the downstream side in an air passing direction.

BRIEF DESCRIPTION OF THE DRAWINGS

Exemplary embodiments of the present invention will be described in detailed based on the following figures, wherein:

FIG. 8A is a sectional view illustrating a passage space and the downstream-most flow control member of the blowing tube. FIG. 8B is a top view illustrating one air hole in an enlarged manner. FIG. 8C is a sectional view of the air hole taken along line VIII-VIII in FIG. 8B;

FIG. 16A is a sectional view illustrating the air holes in an enlarged manner. FIG. 16B is a view illustrating an example of making (a structure of) the air holes;

FIG. 17A is a top view illustrating a configuration example of air holes in an enlarged manner, each of which has an elliptical opening shape. FIG. 17B is a top view illustrating a configuration example of air holes, each of which has a rectangular opening.

DETAILED DESCRIPTION

Hereinafter, forms (hereinafter, referred to as "embodiments") of realizing the present invention will be described with reference to the accompanying drawings.

First Exemplary Embodiment

Figure 1:
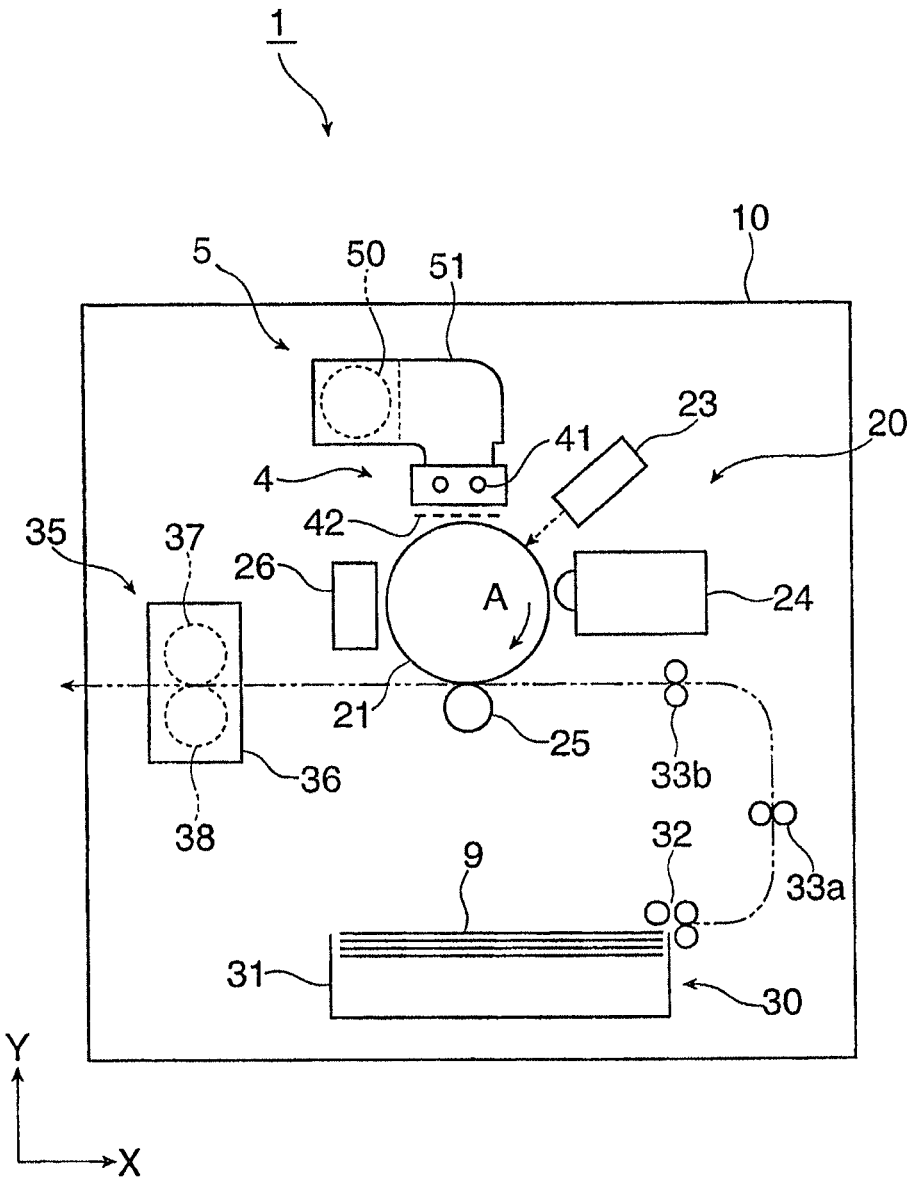
FIG. 1 is a view illustrating an outline of a blowing tube, a blowing device including the blowing tube, and an image forming apparatus of a first exemplary embodiment.
Figure 2:
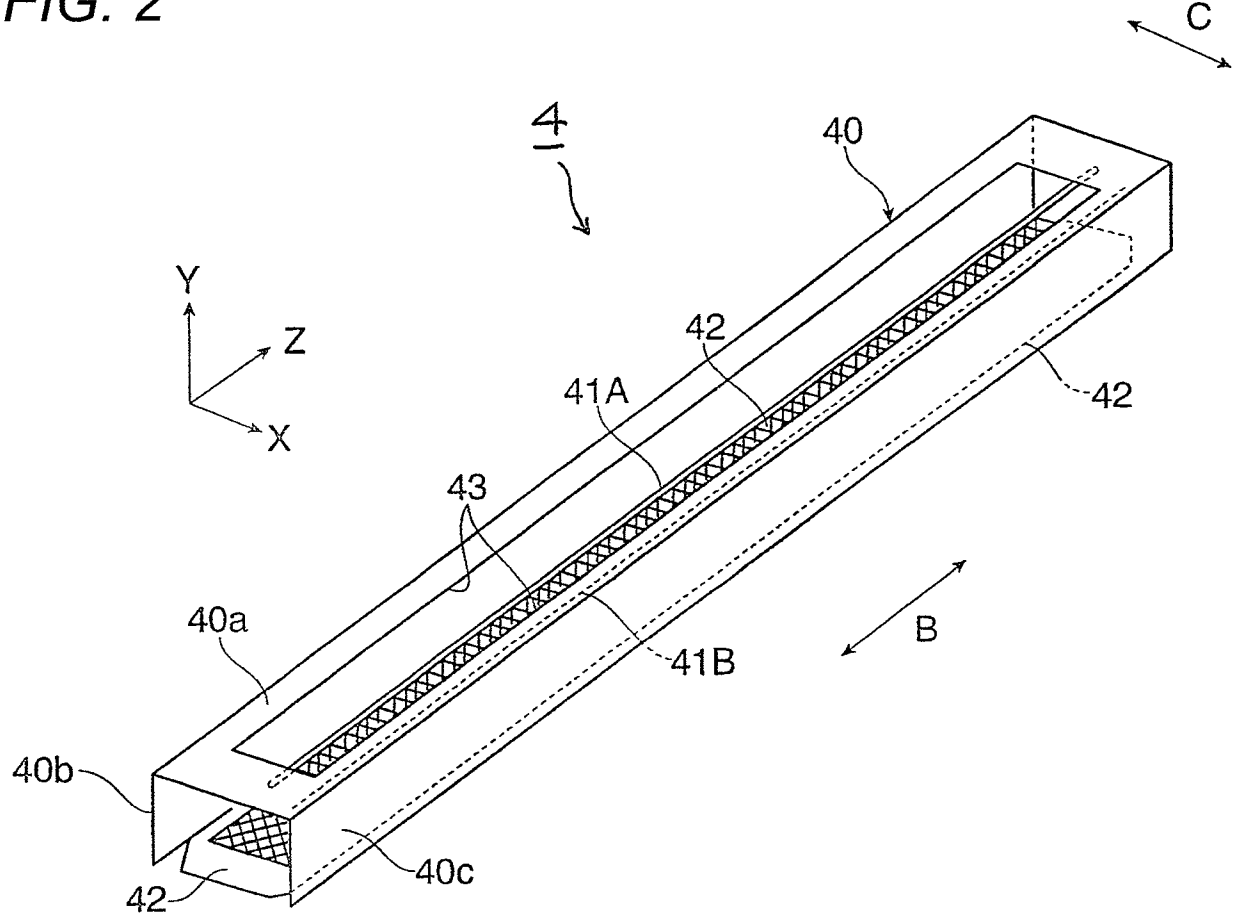
FIG. 2 is a perspective view illustrating an outline of a charging device of the image forming apparatus in FIG. 1.
Figure 3:
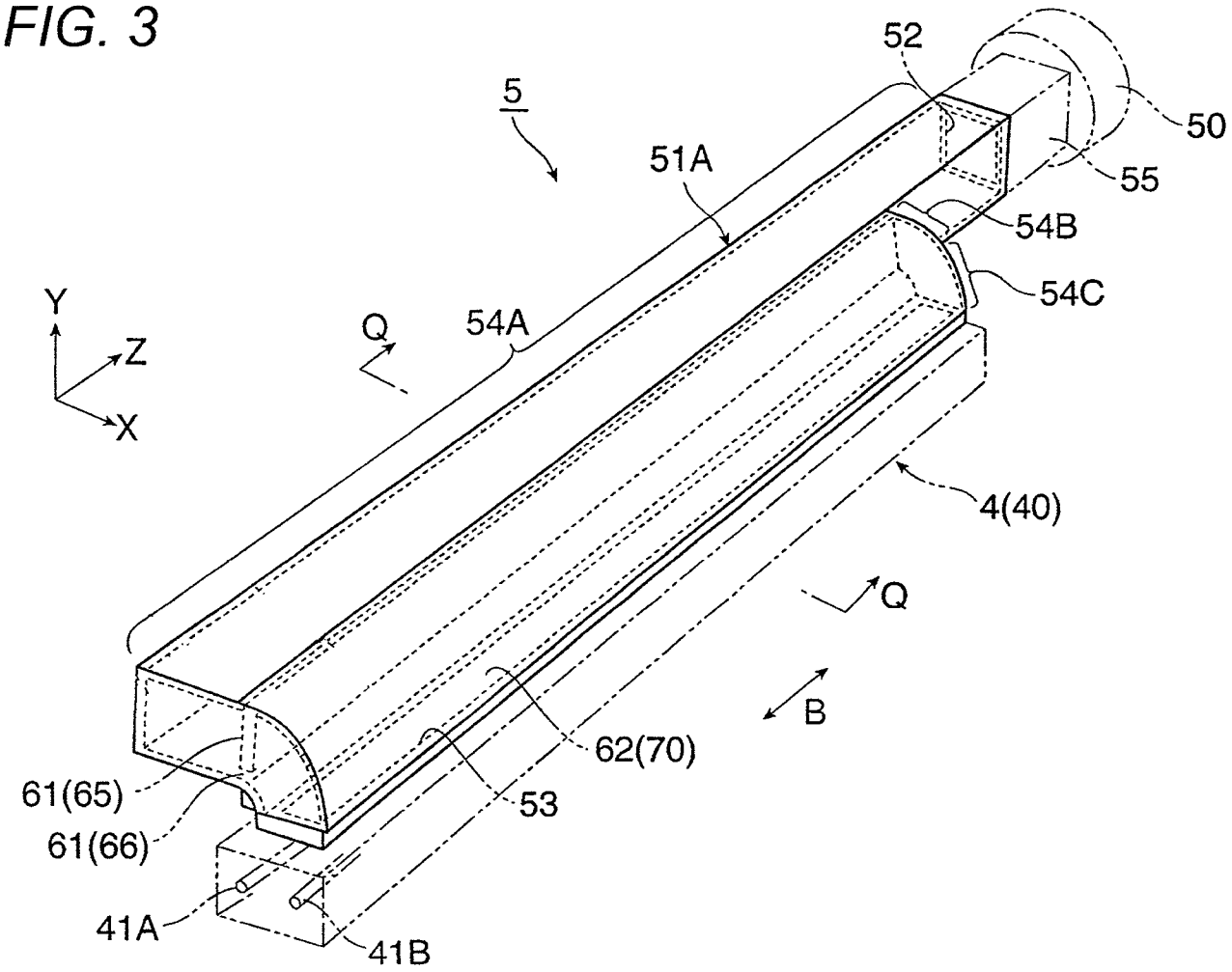
FIG. 3 is a perspective view illustrating an outline of the blowing device which is applied to the charging device in FIG. 2.
Figure 4:
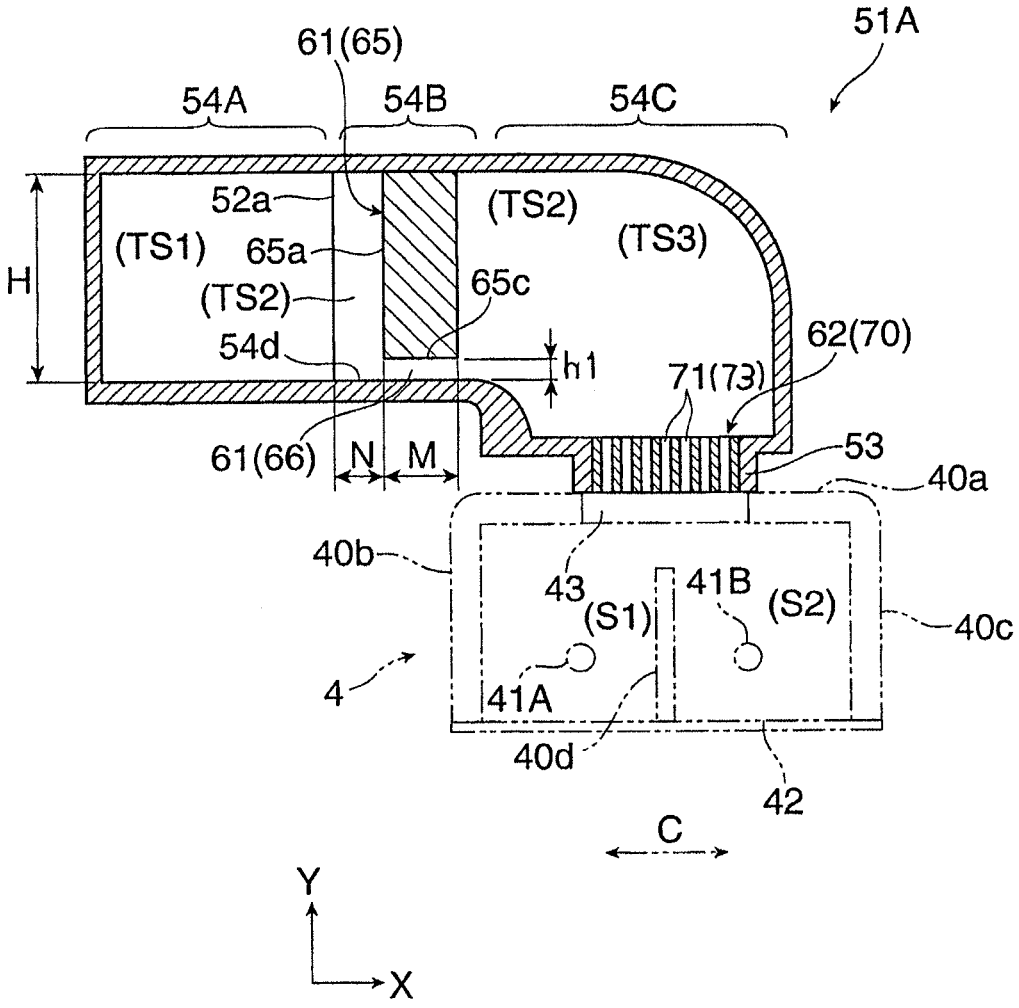
FIG. 4 is a sectional view of the blowing device (mainly the blowing tube) taken along line IV-IV in FIG. 3.

FIGS. 1 to 4 illustrate a blowing duct as an example of a blowing tube, a blowing device including the blowing duct, and an image forming apparatus of the first exemplary embodiment. FIG. 1 illustrates an outline of the image forming apparatus. FIG. 2 illustrates a charging device which is an example of a target structure to which air has to blow from the blowing duct or the blowing apparatus. FIG. 3 illustrates an outline of the blowing duct and the blowing apparatus. FIG. 4 illustrates the inner structure of the blowing duct and the like.

[Configuration of Image Forming Apparatus]

As illustrated in FIG. 1, an image forming apparatus 1 includes the following components disposed in an internal space of a housing 10 including a support frame, an exterior cover, and the like: an image forming unit 20 that forms a toner image formed of a toner which is a developer, and transfers the toner image onto a recording sheet 9 which is an example of a recording material; a sheet feeding device 30 that accommodates and transports the recording sheet 9 to the image forming unit 20; and a fixing device 35 that fixes the toner image, which is formed by the image forming unit 20, to the recording sheet 9; and the like.

The image forming unit 20 is an image forming device that is configured as a well-known electrophotographic system. Specifically, the image forming unit 20 includes mainly a photoconductor drum 21 is driven to rotate in the direction of an arrow A; a charging device 4 that charges a circumferential surface (image forming region) of the photoconductor drum 21 to a desired potential; an exposure device 23 that forms an electrostatic latent image on the charged circumferential surface of the photoconductor drum 21 by irradiating light (illustrated by a dotted line with an arrowhead) based on image information (signals) input from an external device; a developing device 24 that develops the electrostatic latent image into a toner image with a toner; a transfer device 25 that transfers the toner image from the photoconductor drum 21 onto the recording sheet 9; and a cleaning device 26 that cleans the circumferential surface of the photoconductor drum 21 by removing impurities such as a toner residing on the circumferential surface after transfer.

A charging device configured as a corona discharger is used as the charging device 4. As illustrated in FIG. 2 and the like, the charging device 4 is configured as a so-called scorotron corona discharger.

That is, the charging device 4 includes a shielding case 40 which is a surrounding member having an exterior shape that includes a rectangular top plate 40*a*, and side plates 40*b* and 40*c* descending from long side portions of the top plate 40*a* which are long in one direction and extend along a longitudinal direction B; two end portion support members (not illustrated) which are attached to both end portions (short side portions) of the shielding case 40 in the longitudinal direction B; two corona discharge wires 41A and 41B which are attached between the two end portion support members such that the two corona discharge wires 41A and 41B are present in an internal space of the shielding case 40 which is long in the longitudinal direction B, and stretch across the internal space while being substantially parallel to each other; a multi-hole grid electrode (electric field adjustment plate) 42 that is attached to a discharge lower opening portion of the shielding case 40 while covering substantially the entire lower opening portion and being present between the corona discharge wires 41A and 41B and the circumferential surface of the photoconductor drum 21. Reference sign 40*d* illustrated in FIG. 4 and the like represents a partition wall plate that divides the inner space of the shielding case 40 into spaces (S1 and S2), in which the two corona discharge wires 41A and 41B are respectively disposed, along the longitudinal direction B. The lower opening portion is formed to have a rectangular opening shape.

The two corona discharge wires 41A and 41B of the charging device 4 are disposed at least such that the two corona discharge wires 41A and 41B face the circumferential surface of the photoconductor drum 21 while being spaced a predetermined gap (for example, discharge gap) therefrom, and face the image forming region of the photoconductor drum 21 along the direction of a rotational axis of the photoconductor drum 21. During the forming of an image, an electric power supply device (not illustrated) supplies a discharge voltage to each of the corona discharge wires 41A and 41B (between the photoconductor drum 21 and the corona discharge wires 41A and 41B) of the charging device 4.

Over the usage of the charging device 4, substances (impurities) such as paper dust of the recording sheet 9, discharge products by a corona discharge, and an external additive of toner are attached to and contaminate the corona discharge wires 41A and 41B or the grid electrode 42. As a result, a corona discharge may be performed insufficiently or non-uniformly, and discharge defects such as a non-uniform discharge may occur. For this reason, a blowing device 5 is provided next to the charging device 4, and blows air toward the corona discharge wires 41A and 41B and the grid electrode 42 so as to prevent or restricting impurities from being attached to the corona discharging wires 41A and 41B and the grid electrode 42. An opening portion 43 is formed in the top plate 40*a* of the shielding case 40 of the charging device 4 so as to take in air delivered from the blowing device 5. The opening portion 43 is formed to have a rectangular opening shape. The blowing device 5 will be described in detail later.

The sheet feeding device 30 includes a sheet container 31 that contains plural recording sheets 9 of a desired size and type which are stacked on top of each other and on which images are formed; and a delivery device 32 that delivers the recording sheets 9, which are contained in the sheet container 31, toward a transporting path one by one. Upon an arrival of a time to feed sheets, the sheet feeding device 30 delivers the recording sheets 9 one by one. The plural sheet container 31 are installed according to usage modes. In FIG. 1, an alternate one long and two short dashes line with an arrowhead represents a transporting path on which the recording sheet 9 is mainly transported and moved in the internal space of the housing 10. The transporting path of the recording sheet 9 includes plural sheet transport roll pairs 33*a* and 33*b*, a transporting guide member (not illustrated), and the like.

The fixing device 35 includes a roll-shaped or belt-shaped heating rotating body 37, the surface temperature of which is heated to and maintained at a desired temperature by a heating unit inside the housing 36 which is provided with an input port and an exit port through which the recording sheet 9 passes; and a roll-shaped or belt-shaped pressing rotating body 38 that is in contact with the heating rotating body 37 at a desired pressure along substantially an axial direction of the heating rotating body 37, and is driven to rotate. In the fixing device 35, a contact portion, in which the heating rotating body 37 is in contact with the pressing rotating body 38 and which is formed therebetween, is configured as a fixing process unit that performs a desired fixing process (heating and pressing). Fixing is performed by inputting to and passing the recording sheet 9, to which a toner image is transferred, through the contact portion.

An image is formed in the following manner by the image forming apparatus 1. Hereinafter, representatively, a basic image forming operation, in which an image is formed on a single surface of the recording sheet 9, will be described.

If the image forming apparatus 1 receives an instruction, which indicates a start of an image forming operation, from a control device (not illustrated), in the image forming unit 20, the circumferential surface of the photoconductor drum 21 starting to rotate is charged to a predetermined polarity and potential by the charging device 4. At this time, the charging device 4 supplies a charge voltage to each of the two corona discharge wires 41A and 41B, and generates a corona discharge which forms an electric field between the corona discharge wires 41A and 41B and the circumferential surface of the photoconductor drum 21. As a result, the circumferential surface of the photoconductor drum 21 is charged to a desired potential. At this time, the charged potential of the photoconductor drum 21 is adjusted by the grid electrode 42.

Subsequently, the exposure device 23 forms an electrostatic latent image having the desired potential by exposing light to the charged circumferential surface of the photoconductor drum 21 based on image information. Thereafter, when the photoconductor drum 21 on which the electrostatic latent image is formed passes through the developing device 24, the electrostatic latent image is developed by a toner which is supplied from a developing roll and is charged to a desired polarity, such that the electrostatic latent image is formed as a toner image.

Subsequently, if the toner image formed on the photoconductor drum 21 is transported to a transfer position facing the transfer device 25 by the rotation of the photoconductor drum 21, the toner image is transferred to the recording sheet 9, which is supplied from the sheet feeding device 30 via the transporting path, via a transfer operation performed by the transfer device 25. The circumferential surface of the photoconductor drum 21 after transfer is cleaned by the cleaning device 26.

Subsequently, after the recording sheet 9, to which the toner image is transferred in the image forming unit 20, is peeled off from the photoconductor drum 21, the recording sheet 9 is transported and input to the fixing device 35. When passing through the contact portion between the heating rotating body 37 and the pressing rotating body 38 of the fixing device 35, the toner image is heated under pressure, and is melt and fixed to the recording sheet 9. The recording sheet 9 after the fixing is complete is output from the fixing device 35, and is transported to and contained in an output sheet container (not illustrated) or the like which is provided outside the housing 10.

A monochrome image formed of a single color toner is formed on the single surface of one recording sheet 9, and the basic image forming operation is ended. If there is an instruction indicating the execution of plural image forming operations, a series of the same aforementioned operations are repeated by the number of image forming operations.

[Configuration of Blowing Device (Mainly Blowing Duct)]

Hereinafter, the blowing device 5 will be described.

As illustrated in FIGS. 1 and 3 and the like, the blowing device 5 includes an air blower 50 including a rotating fan that delivers air, and a blowing duct 51A that takes in air delivered from the air blower 50, guides the air to the charging device 4 which is a target structure for the blowing of air, and outputs the air.

For example, a radial flow type blowing fan is used as the air blower 50. The operation of the air blower 50 is controlled such that the air blower 50 delivers a desired volume of air.

As illustrated in FIGS. 3 to 6 and the like, the blowing duct 51A includes a passage portion (body portion) 54 which is formed such that a passage space TS, through which an inlet port 52 taking in air delivered from the air blower 50 is connected to an outlet port 53 that outputs the air taken in by the inlet port 52 and has an opening shape which is long in the one direction, and through which air flows, is bent two times in the middle of the passage space TS; and two flow control members 61 and 62 that are provided in portions of the passage space TS of the passage portion 54 which are positioned at different positions in an airflow direction, and that control a flow of air.

The inlet port 52 of the blowing duct 51A is formed to have a rectangular opening shape which is slightly horizontally long in its entirety. A connection duct 55 is attached to the inlet port 52 such that the inlet port 52 is connected to the air blower 50 via the connection duct 55, and air generated by the air blower 50 is delivered to the inlet port 52 via the connection duct 55.

Figure 6:
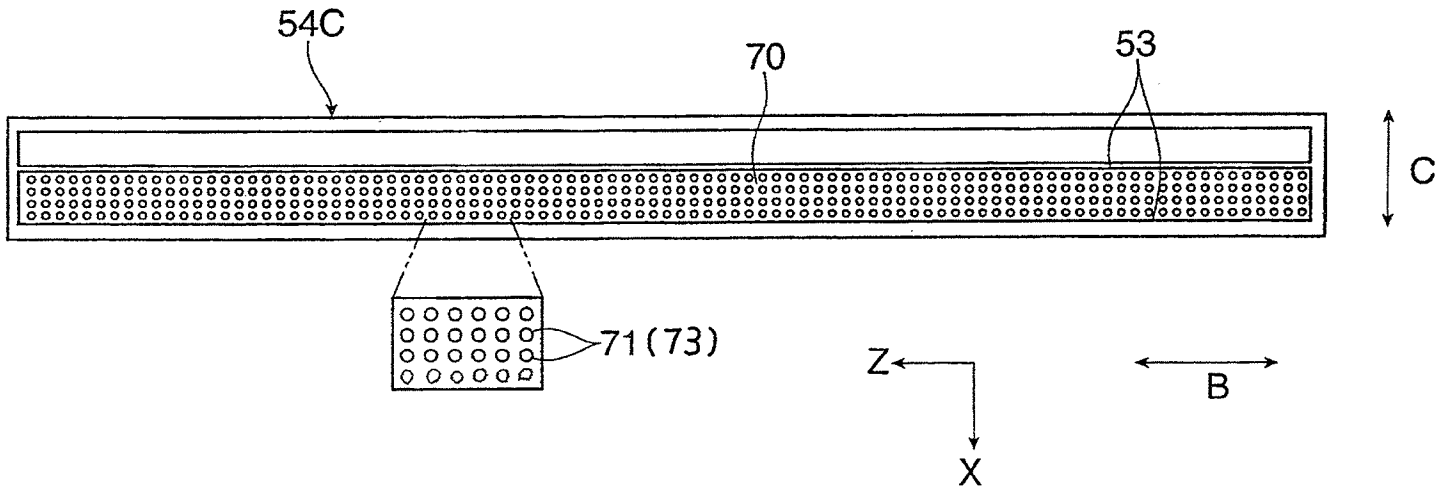
FIG. 6 is a schematic diagram of the blowing device in FIG. 3 which is viewed from the bottom (outlet port)

The outlet port 53 of the blowing duct 51A is formed to have a rectangular opening shape which is elongated in its entirety. The outlet port 53 is disposed to face a longitudinal portion (in this example, the opening portion 43 of the shielding case 40 which will be described later) of the charging device 4 (target for the blowing of air) which is long in one direction and to which air has to blow, while being substantially parallel to the longitudinal portion. As illustrated in FIGS. 4 and 6 and the like, the outlet port 53 is formed to have an opening area slightly smaller than the entire area of a trailing end portion of the passage portion 54 (second bent passage portion 54C) in which the outlet port 53 is present.

Figure 5:
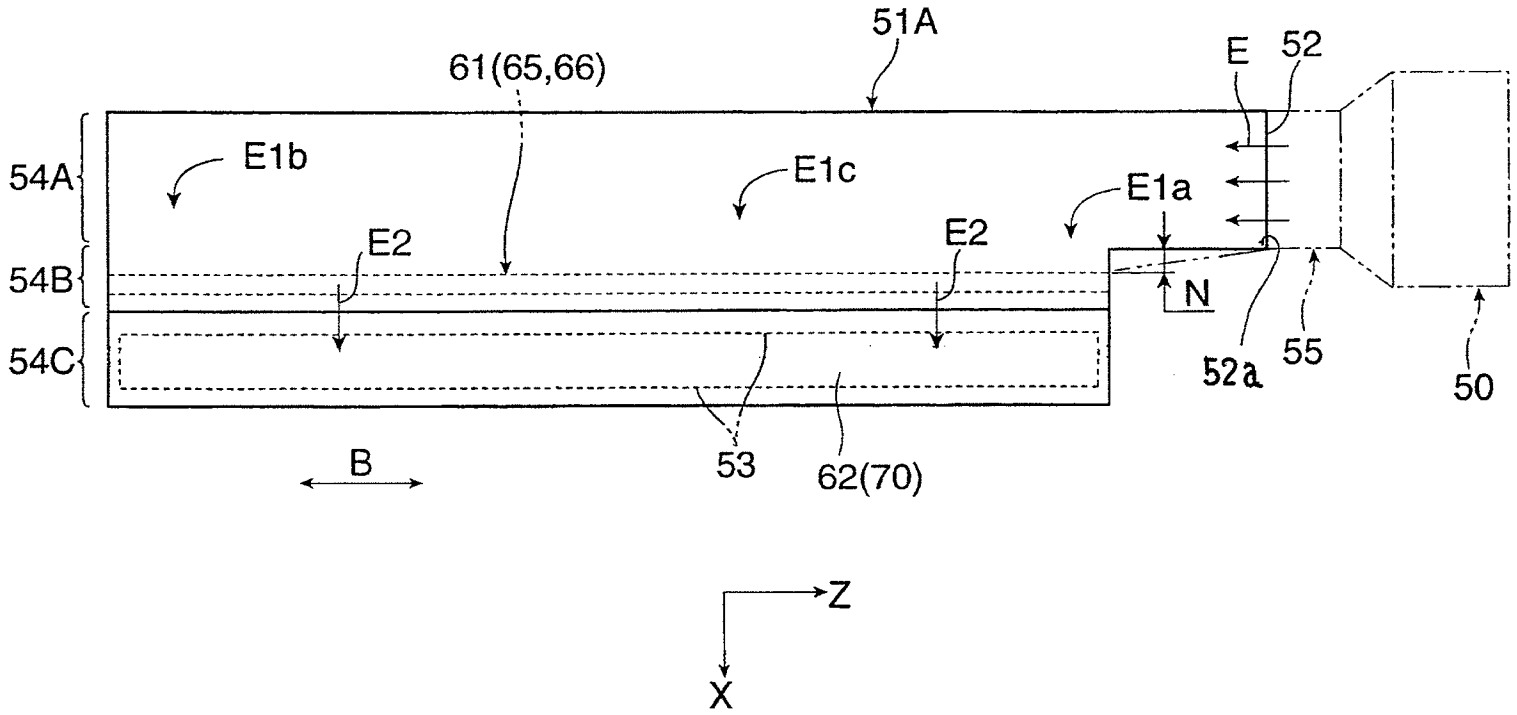
FIG. 5 is a schematic diagram of the blowing device in FIG. 3 which is viewed from the top.

As illustrated in FIGS. 3 to 5 and the like, the passage portion 54 of the blowing duct 51A includes an inlet passage portion 54A; a first bent passage portion 54B; and the second bent passage portion 54C.

The inlet passage portion 54A is a passage portion that extends straight while being substantially parallel to the longitudinal direction B (the same as a longitudinal direction of the charging device 4 and an axial direction of the photoconductor drum 21) which is one direction in which the opening shape of the outlet port 53 is long, and that includes a first passage space TS1 having a squared tubular shape in which the inlet port 52 is present in one end portion in a longitudinal direction of the first passage space TS1. The inlet passage portion 54A includes the other end portion that is closed and opposite to the end portion in which the inlet port 52 is present.

The first bent passage portion 54B is a bent passage portion that extends from a portion (middle) (present close to the other end portion) of the inlet passage portion 54A while being bent at substantially the right angle toward substantially a horizontal direction (substantially parallel to a direction represented by a coordinate axis X in FIG. 4 and the like), and that includes a second passage space TS2 having a flat squared tubular shape. The first bent passage portion 54B is a passage portion, of which the entire cross-sectional passage area of the second passage space TS2 is extended and increased in the horizontal direction by setting the height of the second passage space TS2 to a height H of the first passage space TS1, and increasing the width (dimension in the longitudinal direction B) of the second passage space TS2 by W relative to the inlet passage portion 54A. The first bent passage portion 54B is a bent passage portion that is initially bent at a position closest to the inlet port 52 in the blowing duct 51A.

The second bent passage portion 54C is a bent passage portion which is bent downward at a desired curvature from an end portion (positioned on the downstream side of the airflow direction) of the first bent passage portion 54B in a vertical direction (substantially parallel to a direction represented by a coordinate axis Y), and extends to approach the charging device 4 that is a target object for the blowing of air, and in which a third passage space TS3 is formed. The second bent passage portion 54C is a bent passage portion, of which the width (dimension in the longitudinal direction B) of the third passage space TS3 is the same as that of the second passage space TS2 of the first bent passage portion 54B, and which is bent downward from the second passage portion TS2. The outlet port 53 having the aforementioned configuration is provided in a trailing end portion of the second bent passage portion 54C.

Figure 7:
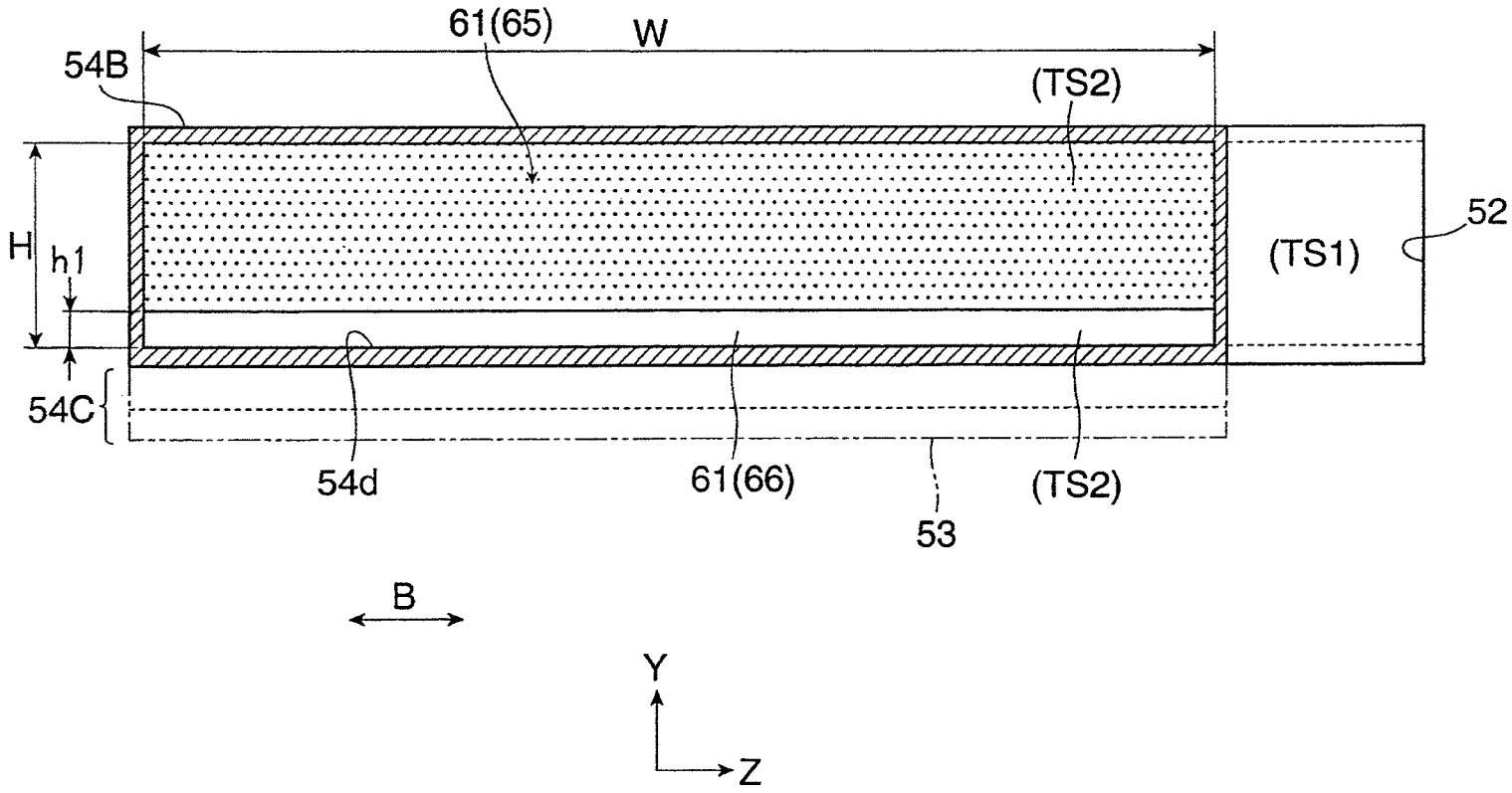
FIG. 7 is a partial sectional view illustrating a configuration of a first flow control member of the blowing tube.

As illustrated in FIGS. 4 and 7 and the like, the flow control member 61 of the blowing duct 51A is provided as a first flow control member 61 that includes a plate-shaped blocking portion 65 blocking a flow of air and an air passage portion 66 through which air passes. The blocking portion 65 is configured as a plate-shaped portion (member) that is disposed across a portion of the second passage space TS2 of the first bent passage portion 54B so as to block a flow of air. In contrast, the air passage portion 66 is configured as a portion (member) that is disposed between an end of the blocking portion 65 and an inner wall surface (bottom surface) 54*d* which is present inward in the second passage space TS2 of the first bent passage portion 54B in a bent direction of the second bent passage portion 54C, and that has a rectangular opening shape through which air passes.

The blocking portion 65 and the air passage portion 66 of the first flow control member 61 are disposed in the second passage space TS2 while being substantially parallel to the longitudinal direction B of opening shape of the outlet port 53. As illustrated in FIGS. 4 and 5 and the like, the plate-shaped blocking portion 65 is disposed such that a surface portion 65*a* of the plate-shaped blocking portion 65 positioned on the upstream side of the airflow direction is positioned while being offset by a desired distance N from a side end portion 52*a* (present close to the outlet port 53) of an opening portion of the inlet port 52 toward the downstream side of the second passage space TS2 of the first bent passage portion 54B in the airflow direction. In contrast, an opening shape of the air passage portion 66 has a height (dimension of a gap between a lower end 65*c* of the blocking portion 65 and the bottom surface 54*d* of the second passage space TS2) h1, a width (the same as that of the second passage space TS2) W, and a path length (dimension in the airflow direction and the same as the thickness of the blocking portion 65) M which are respectively set to desired dimensions.

The blocking portion 65 of the first flow control member 61 may be integrally molded with the same material as that of the blowing duct 51A. The blocking portion 65 may be manufactured separately from the blowing duct 51A, and post-attached to the blowing duct 51A. In the first flow control member 61, the disposition position (distance N) of the blocking portion 65, and the values of the height h1, the width W, and the path length M of the air passage portion 66 are selected and set such that the air speed of air flowing into the first bent passage portion 54B from the inlet passage portion 54A becomes uniform as much as possible. The values are set while taking into consideration the dimensions of the blowing duct 51A (the volume of the passage portion 54), the flow rate of air (the volume of air), which has to flow through the blowing duct 51A or the charging device 4 per unit time, or the like.

The other flow control member 62 of the blowing duct 51A is provided as a downstream-most flow control member that is present at the extremity (outlet port 53) of the second bent passage portion 54C. The downstream-most flow control member 62 is configured such that the outlet port 53 is blocked by a multi-hole member 70 including plural air holes 71.

The multi-hole member 70 of the first exemplary embodiment is configured as a multi-hole plate obtained by providing the plural air holes 71 in a plate-shaped base material 75 in a uniform dotted pattern. As illustrated in FIG. 6, each of the plural air holes 71 is a through hole, having a circular opening shape, which passes through the multi-hole member 70 and extends along an air passing direction. The plural air holes 71 are disposed at equal intervals along the longitudinal direction B of the opening shape of the outlet port 53, and are disposed in plural lines (for example, 4 to 7 lines) while being also present at the same or different equal intervals in a lateral direction C perpendicular to the longitudinal direction B. As a result, the plural air holes 71 are present in substantially a uniform dotted pattern in the entire region of the third passage space TS3 or the opening shape of the outlet port 53 at the extremity of the second bent passage portion 54C.

Figure 8A:
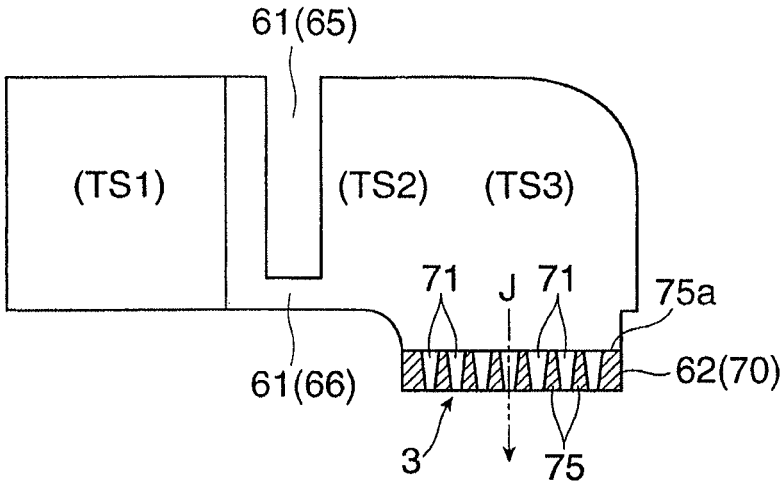
FIGS. 8A to 8C illustrate a configuration of air holes of a multi-hole member that forms a downstream-most flow control member of the blowing tube.
Figure 8B:
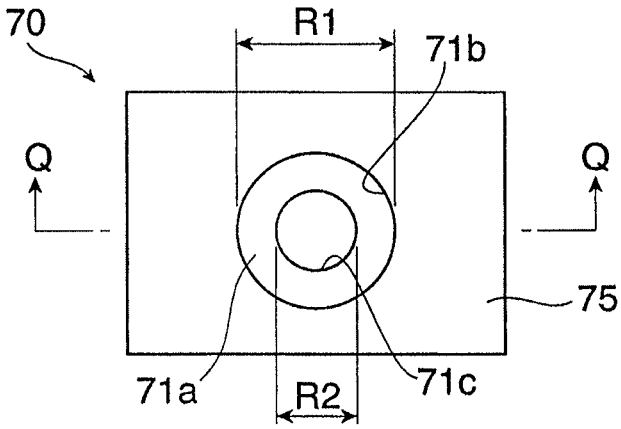
Figure 8C:
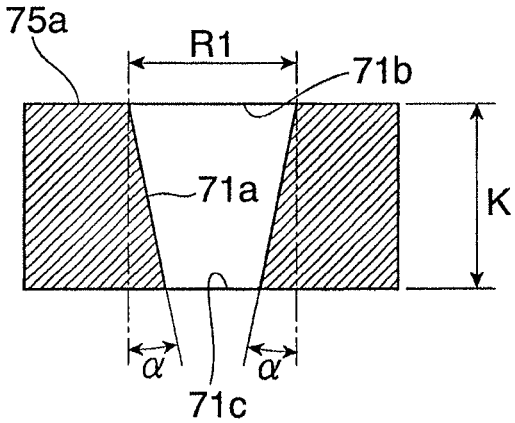

As illustrated in an enlarged manner in FIGS. 8A to 8C and the like, each of the plural air holes 71 of the multi-hole member 70 is configured as a through hole, the opening area of which continuously decreases toward the downstream side in an air passing direction J.

In the first exemplary embodiment, since the air hole 71 has an opening shape of a circular, the opening area of the air hole 71 is continuously decreased toward the downstream side in the air passing direction J by continuously decreasing a diameter R of the circular opening toward the downstream side in the air passing direction J. Specifically, in the first exemplary embodiment, the air hole 71 is formed such that an inner wall surface 71*a* of the air hole 71 is inclined toward the center of the hole by a desired inclination angle (slope) $\alpha$ relative to a line (represented by an alternate one long and two short dashes line) perpendicular to an inner surface 75*a* which faces the third passage space TS3 among surfaces of the base material 75 (refer to FIG. 8C). As a result, in the first exemplary embodiment, the air hole 71 in the plate-shaped base material 75 is a through hole in which an opening end (end portion on the upstream side in the air passing direction J) 71*b* of the air hole 71 has the maximum diameter R1, and an opening end (end portion on the downstream side in the air passing direction J) 71*c* of the air hole 71 has the minimum diameter R2 (refer to FIG. 8B). That is, the inner wall surface 71*a* of the air hole 71 has the shape of an outer circumferential surface of a truncated cone.

The multi-hole member 70 may be integrally molded with the same material as that of the blowing duct 51A. The multi-hole member 70 may be manufactured separately from the blowing duct 51A, and post-attached to the blowing duct 51A. The opening shape of the air hole 71, the values of the opening dimensions and the hole length of the air hole 71, and the value of the density of holes are selected and set such that the air speed of air, which flows out from the second bent passage portion 54C via the outlet port 53, becomes uniform as much as possible. The values set while taking into consideration the dimensions of the blowing duct 51A (the volume of the passage space TS of the passage portion 54), the flow rate of air, which has to flow through the blowing duct 51A or the charging device 4 per unit time, or the like.

[Operation of Blowing Device]

Hereinafter, an operation (operation associated with mainly the blowing duct 51A) of the blowing device 5 will be described.

Upon an arrival of a drive set time such as an image forming operation, first, the blowing device 5 drives the rotation of the air blower 50, and delivers a desired volume of air. After air (E) delivered from the started air blower 50 is taken in by the inlet port 52 of the blowing duct 51A via the connection duct 55, the air (E) is delivered, and flows into the first passage space TS1 of the inlet passage portion 54A that is continuous with the inlet port 52 (refer to FIG. 5).

Figure 9:
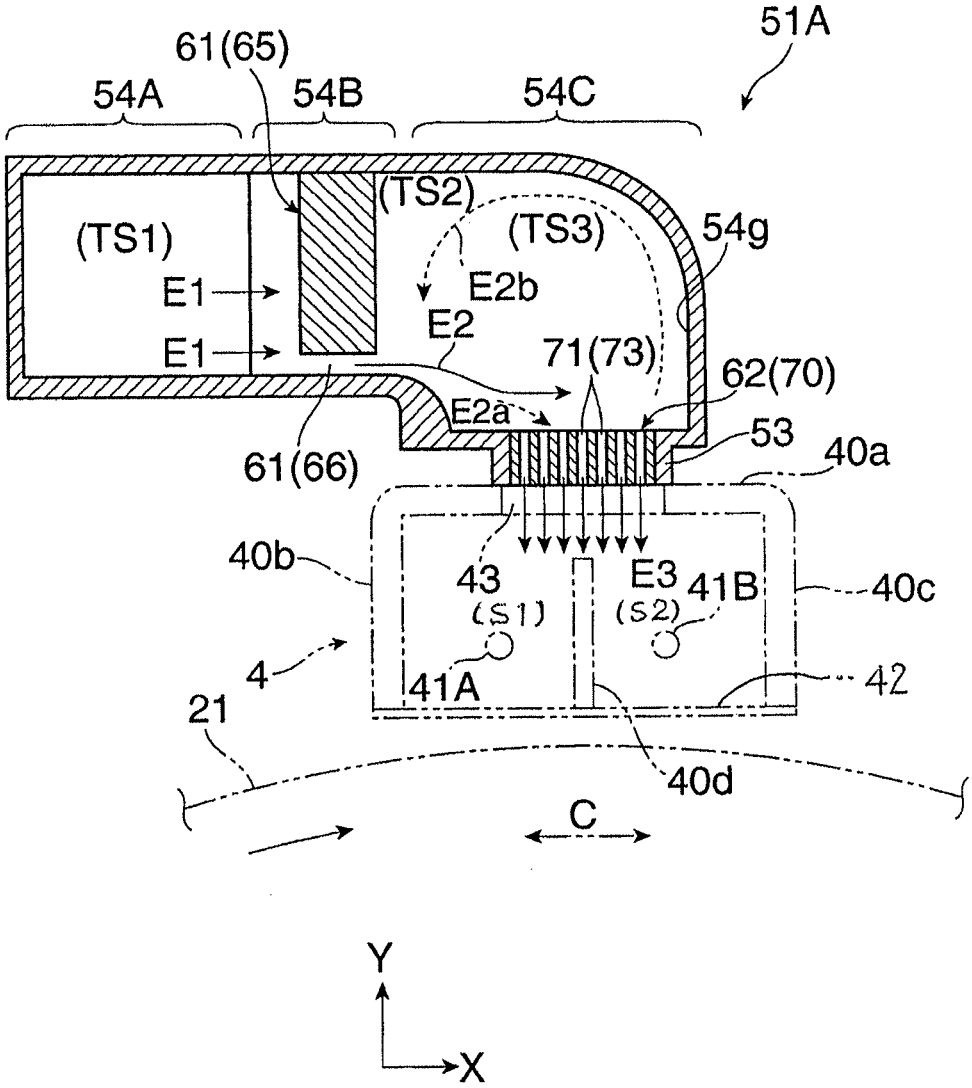
FIG. 9 is a view illustrating an operation state of the blowing device in FIG. 3.

Subsequently, as illustrated in FIG. 5 or 9, the air (E) taken into the blowing duct 51A flows into the second passage space TS2 of the first bent passage portion 54B via the first passage space TS1 of the inlet passage portion 54A (refer to arrows E1*a*, E1*b*, E1*c*, and the like). Air (E1) flowing into the first bent passage portion 54B is blocked by the blocking portion 65 of the first flow control member 61, and passes through the air passage portion 66 of the first flow control member 61, and advances in a state where an advancing direction (airflow direction) of the air (E1) is changed at substantially the right angle.

Since air (E2), which is air passing through the air passage portion 66 of the first flow control member 61, passes through the air passage portion 66 having an opening shape (opening area) relatively smaller than the sectional area of the first passage space TS1 of the inlet passage portion 54A, a flow of the air (E2) is controlled and the pressure of the air (E2) increases. As a result, the air (E2) uniformly flows out from the air passage portion 66.

Subsequently, the air (E2), which passes through the air passage portion 66 of the first flow control member 61 and flows to the third passage space TS3 of the second bent passage portion 54C, advances while slightly being bent downward. Air (E2*a*), which is a portion of the air (E2), advances toward the outlet port 53 positioned on the lower side. Air (E2*b*), which is the rest of the air (E2), advances while diffusing in a state where the rest of the air (E2) collides with an inner wall surface 54*g* of the second bent passage portion 54C which is spaced away from the air passage portion 66 of the first flow control member 61, and swirls in the third passage space TS3 which is wide and positioned above the outlet port 53. The air (E2*b*), which advances while swirling, approaches the air (E2), which passes through the air passage portion 66 of the first flow control member 61 and flows into the third passage space TS3, from the upper side of the air (E2) and merges into the air (E2), and the air (E2*b*) presses a flow of the air (E2) slightly downward.

At this time, the air (E2) flowing into the third passage space TS3 temporarily stays in the third passage space TS3 due to the air (E2*b*) which advances while diffusing in a state where the air (E2*b*) swirls particularly in the third passage space TS3 (strictly speaking, including a remaining portion of the second passage space TS2) having a volume larger than the space of the air passage portion 66 of the first flow control member 61. As a result, air speed variations of the air (E2) are reduced.

As illustrated by the arrow E3 in FIG. 9, finally, air, which flows into the third passage space TS3 of the second bent passage portion 54C, is output from the outlet port 53 by passing through the plural air holes 71 of the multi-hole member 70 which is provided in the outlet port 53 at the extremity of the second bent passage portion 54C and forms the downstream-most flow control member 62.

Since air (E3), which is output from the outlet port 53, passes through the plural air holes 71 of the multi-hole member 70 which have an area relatively smaller than the third passage space TS3 of the second bent passage portion 54C and the opening area of the outlet port 53, a flow of the air (E3) is controlled and the pressure of the air (E3) increases. As a result, the air (E3) uniformly flows out from the outlet port 53.

Figure 10:
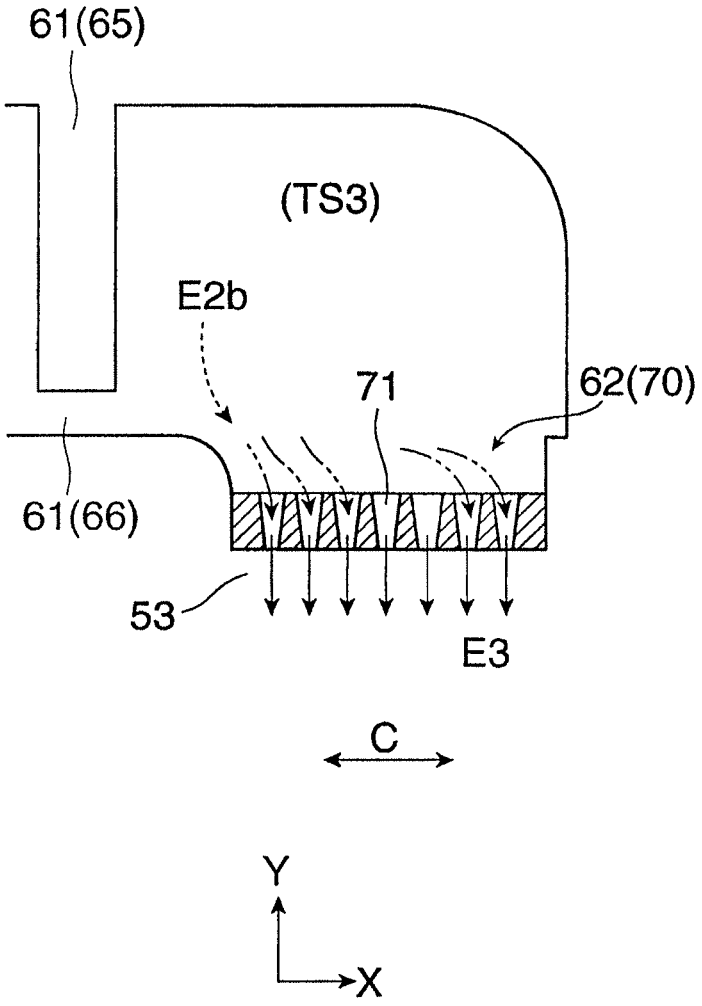
FIG. 10 is a view illustrating an operation state in the downstream-most flow control member of the blowing tube in FIG. 9 in an enlarged manner.

As illustrated in FIG. 10, since each of the plural air holes 71 of the multi-hole member 70 is a through hole, the opening area of which continuously decreases toward the downstream side in the air passing direction J, as illustrated by alternate one long and two short dashes lines with arrowheads, particularly, the air (E2*b*), which flows while swirling in the third passage space TS3 of the second bent passage portion 54C, is likely to be input into the air holes 71, and the air (E2*b*) is likely to pass through all of the air holes 71 of the multi-hole member 70. Since the air passes through a space in which the opening area of the air hole 71 decreases toward the downstream side in the air passing direction J and a passage is gradually reduced, a pressure loss occurs in the air that passes through the air holes 71. As a result, the air speed of the air (T3), which passes through the air holes 71 and is output, is likely to be uniform.

As described above, since the air (E3) is output from the outlet port 53 of the blowing duct 51A while passing through the two flow control members 61 and 62, there is a small air speed variation or almost no air speed variation particularly in the longitudinal direction B of the opening shape (elongated rectangular opening) of the outlet port 53. Since the air (E3) is output from the outlet port 53 while passing through the two flow control members 61 and 62, there is also a small air speed variation or no air speed variation in a predetermined range in not only the longitudinal direction B but also the lateral direction C of the opening shape of the outlet port 53.

As illustrated in FIG. 9, after the air (E3), which is output from the outlet port 53 of the blowing duct 51A of the blowing device 5, blows and flows into the shielding case 40 via the opening portion 43 of the shielding case 40 of the charging device 4, the air (E3) blows to the corona discharge wires 41A and 41B that are respectively positioned in the spaces (S1 and S2) into which an internal space S of the shielding case 40 is divided by the partition wall 40*d*, and the air (E3) blows to the grid electrode 42 which is positioned in the lower opening portion of the shielding case 40.

Since the air (E3) blowing to the corona discharge wires 41A and 41B and the grid electrode 42 is likely to be output at a substantially uniform air speed in the longitudinal direction B and the lateral direction C of the opening shape of the outlet port 53 of the blowing duct 51A, the air (E3) substantially uniformly blows to the grid electrode 42 in the longitudinal direction B, and substantially uniformly flows to the two corona discharge wires 41A and 41B.

Accordingly, it is possible to avoid the attachment of impurities, for example, paper dust, an external additive of toner, and discharge products, to the two corona discharge wires 41A and 41B and the grid electrode 42 of the charging device 4 without variations by blowing more uniform air thereto.

As a result, it is possible to prevent the occurrence of deterioration such as a variation in discharging performance (charging performance) of the charging device 4 which is caused by the sparse attachment of impurities to the corona discharge wires 41A and 41B or the grid electrode 42, and it is possible to more uniformly (uniformly in the direction of the rotational axis of the photoconductor drum 21) charge the circumferential surface of the photoconductor drum 21 over a long period of time.

[Tests]

Tests were performed to evaluate performance characteristic (distribution of the air speed of air output from the outlet port 53 of each of the blowing ducts 51A) of each of the blowing devices 5 to which the blowing ducts 51A having the following configurations are applied.

In each test, when the air blower 50 inputted air into the blowing duct 51A having the configuration via the inlet port 52 at an average air volume of 0.27 m3/min, the air speed of the air output from the outlet port 53 was measured via simulation.

Figure 11:
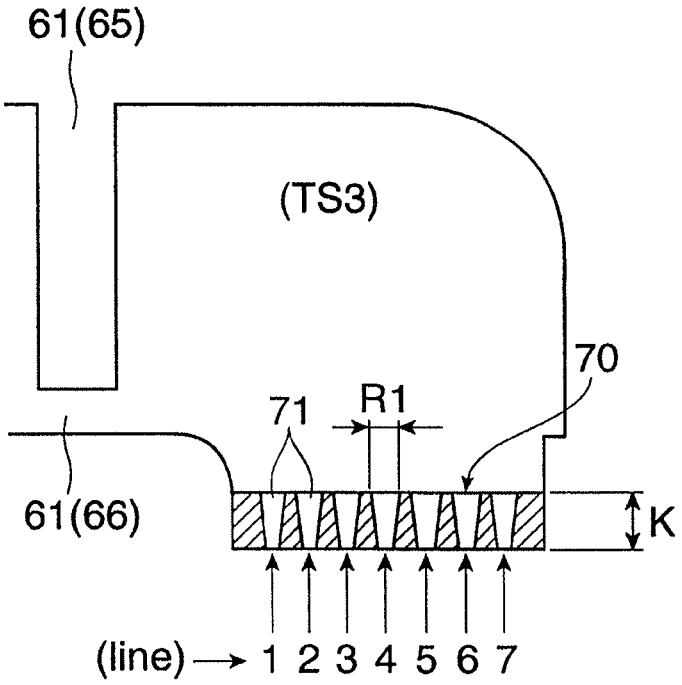
FIG. 11 is a view illustrating a configuration of a multi-hole member (air holes) of a blowing tube of an example used in tests.

As illustrated in FIG. 6 or 11, the tested multi-hole member 70 of the downstream-most flow control member 62 provided in the outlet port 53 had a configuration in which the plural air holes 71 were lined up at equal intervals along the longitudinal direction B of the outlet port 53, and seven lines of the air holes 71 were disposed at equal intervals in the lateral direction C of the outlet port 53. An operator measured the air speed of air output from the air holes 71 disposed in a second line (line 2) to a sixth line (line 6) among the seven lines, apart from lines (first line: line 1 and seventh line: line 7) disposed at both ends in the lateral direction C. In addition, a fourth line (line 4) was equivalent to substantially the position of the center of the outlet port 53 in the lateral direction C.

The blowing duct 51A included the passage portion 54 having the entire shape illustrated in FIGS. 3 to 8. The inlet port 52 was configured as a substantially square (rectangular shape having a slightly long vertical length) opening having 23 mm×22 mm (vertical dimension×horizontal dimension), and the outlet port 53 has an elongated rectangular opening shape of 350 mm×17.5 mm (dimension in the longitudinal direction B×dimension in the lateral direction C). The second passage space TS2 of the first bent passage portion 54B was configured as a passage space with a rectangular cross-section having a width W of 354 mm and a height H of 23 mm. The total volume of all of the passage spaces TS1 to TS3 of the blowing duct 51A was approximately 450 cm3.

The first flow control member 61 of the blowing duct 51A was provided such that the upstream surface portion 65*a* of the blocking portion 65 was present in a portion of the second passage space TS2 of the first bent passage portion 54B which was offset by a distance N of 6 mm from one side end portion 52*a* of the inlet port 52 (refer to FIG. 4). As illustrated in an alternate one long and two short dashes line in FIG. 5, in the tests, the blowing duct 51A was formed such that the one side end portion 52*a* of the inlet port 52 was connected to an end portion (present close to the inlet port 52) of the first flow control member 61 via a planar inner wall surface.

The thickness (path length M of the air passage portion 66) of the blocking portion 65 of the first flow control member 61 was set to 8 mm. In contrast, the air passage portion 66 of the first flow control member 61 was configured as a rectangular opening shape having a height h1 of 1.5 mm, a width W of 354 mm, and a path length M of 8 mm.

The second flow control member 62 of the blowing duct 51A was configured as the multi-hole member 70 in which the air holes 71 having a hole diameter of 1 mm and a length (thickness of the base material 75) of 3 mm were provided at a density of approximately 42 pieces/cm2 while being disposed in seven lines.

As illustrated in FIG. 11, the based material 75 of the tested multi-hole member 70 had a thickness K of 3 mm, and was provided with the air holes 71 having a shape (sectional shape) in which the opening end portion 71*b* positioned in the inner surface 75*a* had a hole diameter R1 of φ1 mm and the inner wall surface 72 had any inclination angle α (refer to FIG. 8C) of 1°, 2°, and 3°.

Measurements were performed via simulation on the blowing ducts 51A to which the multi-hole members 70 provided with the air holes 71 were respectively applied.

Figure 13:
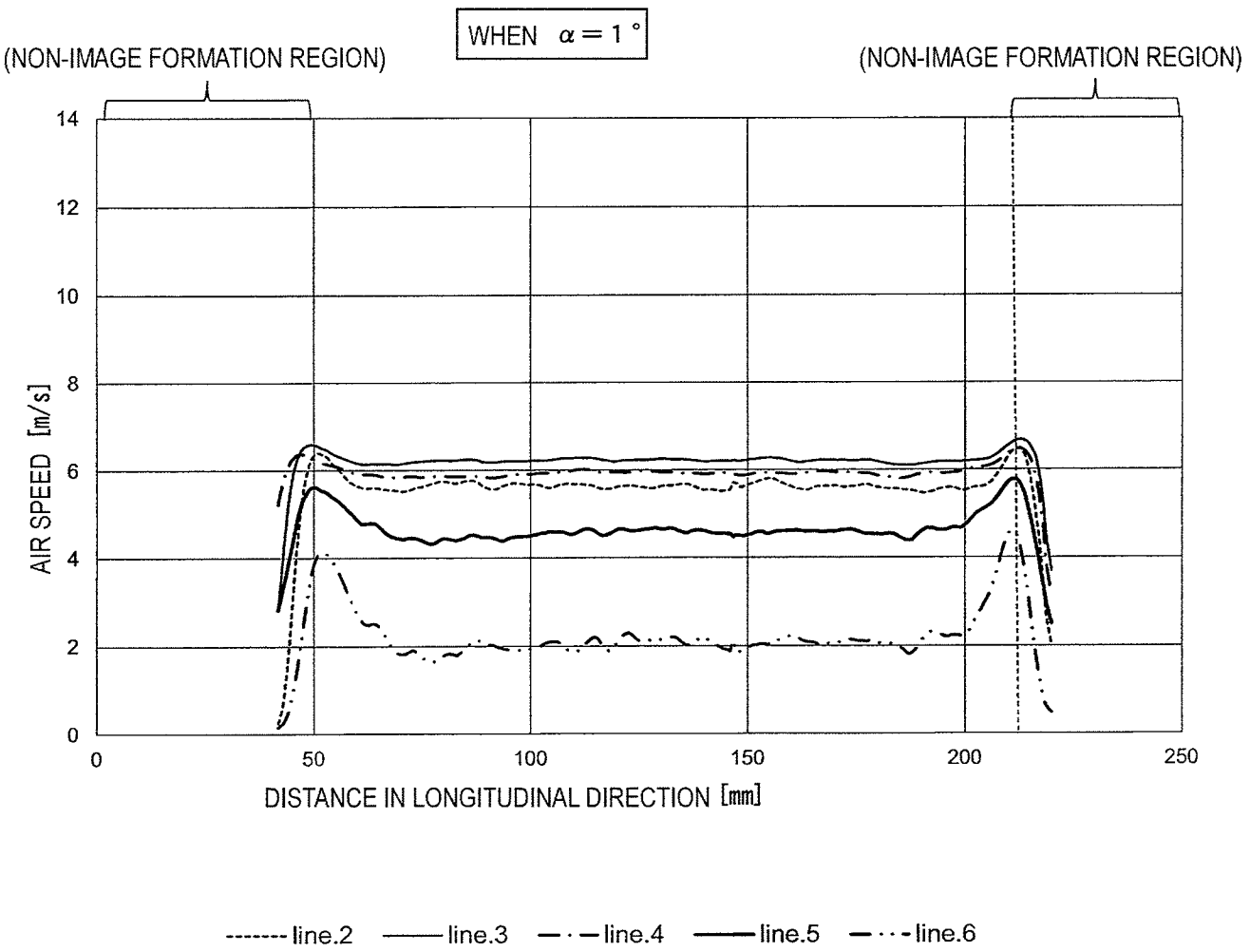
FIG. 13 is a graph illustrating a result of testing the blowing tube of the example ($\alpha$=1°)
Figure 14:
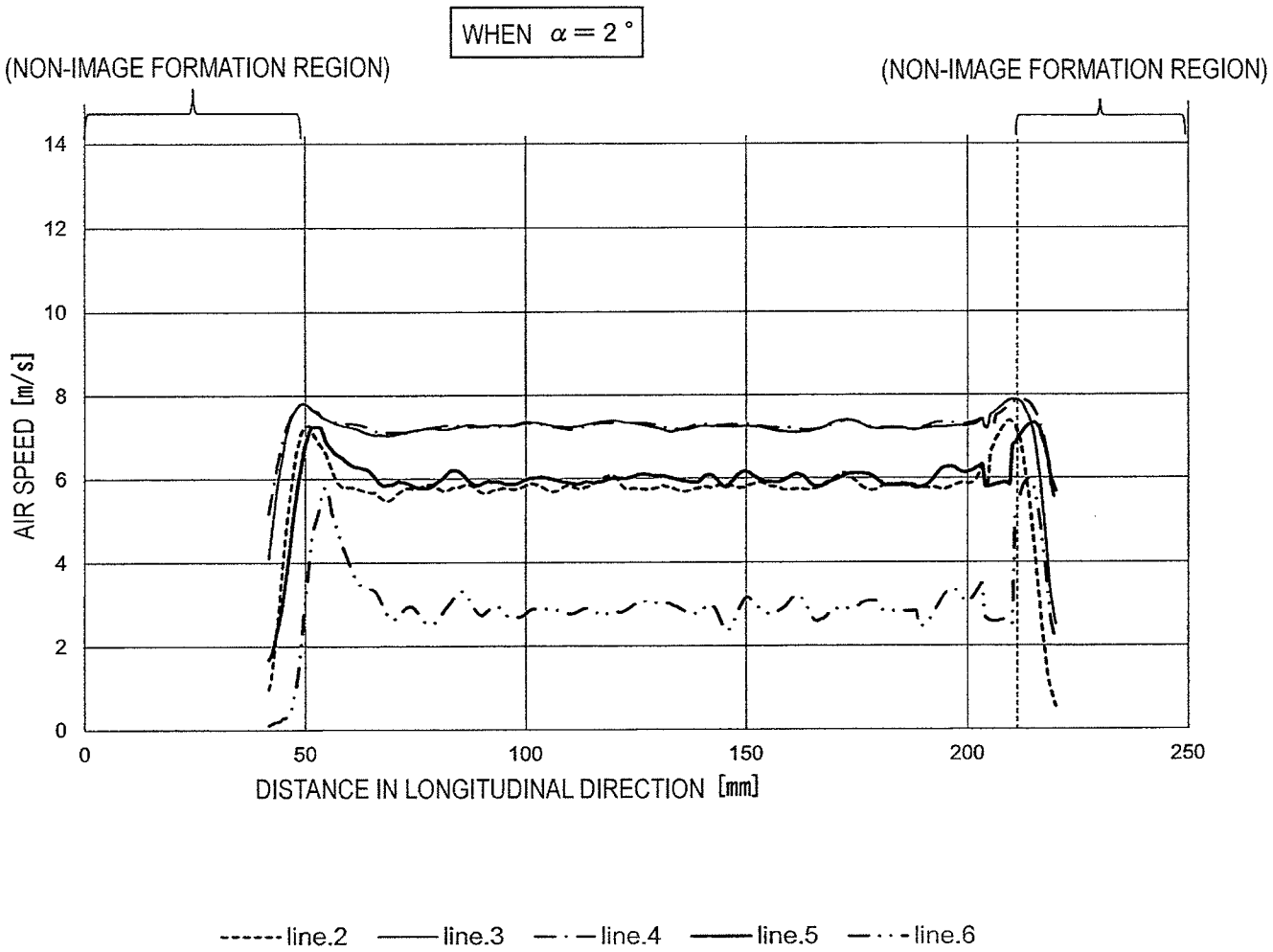
FIG. 14 is a graph illustrating a result of testing the blowing tube of the example ($\alpha$=2°)
Figure 15:
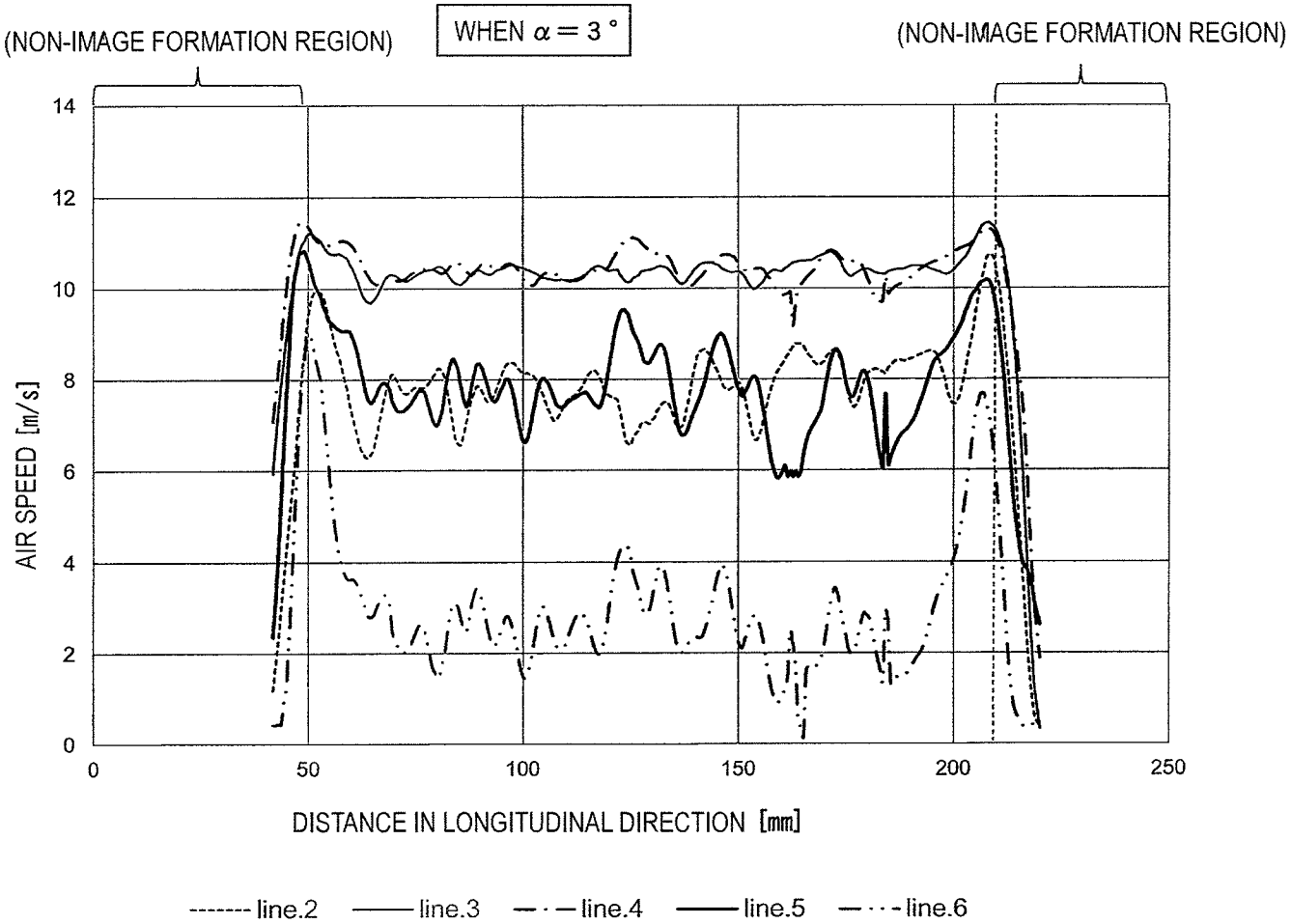
FIG. 15 is a graph illustrating a result of testing the blowing tube of the example ($\alpha$=3°)

Test results are illustrated in FIGS. 13 to 15.

For the purpose of comparison, the same test was performed on a blowing duct (comparative example) to which the multi-hole member 70, which was provided with the air holes 71 having a shape (in other words, a shape in which the opening area of each air hole was constant) in which the inclination angle α of the inner wall surface 72 was "0°", was applied.

The blowing duct of the comparative example was different from the blowing duct 51A (example) in that the inclination angle α of the air hole 71 was set to a different value as described above, and the rest of the configuration was the same as that of the blowing duct 51A used in the tests.

Figure 12:
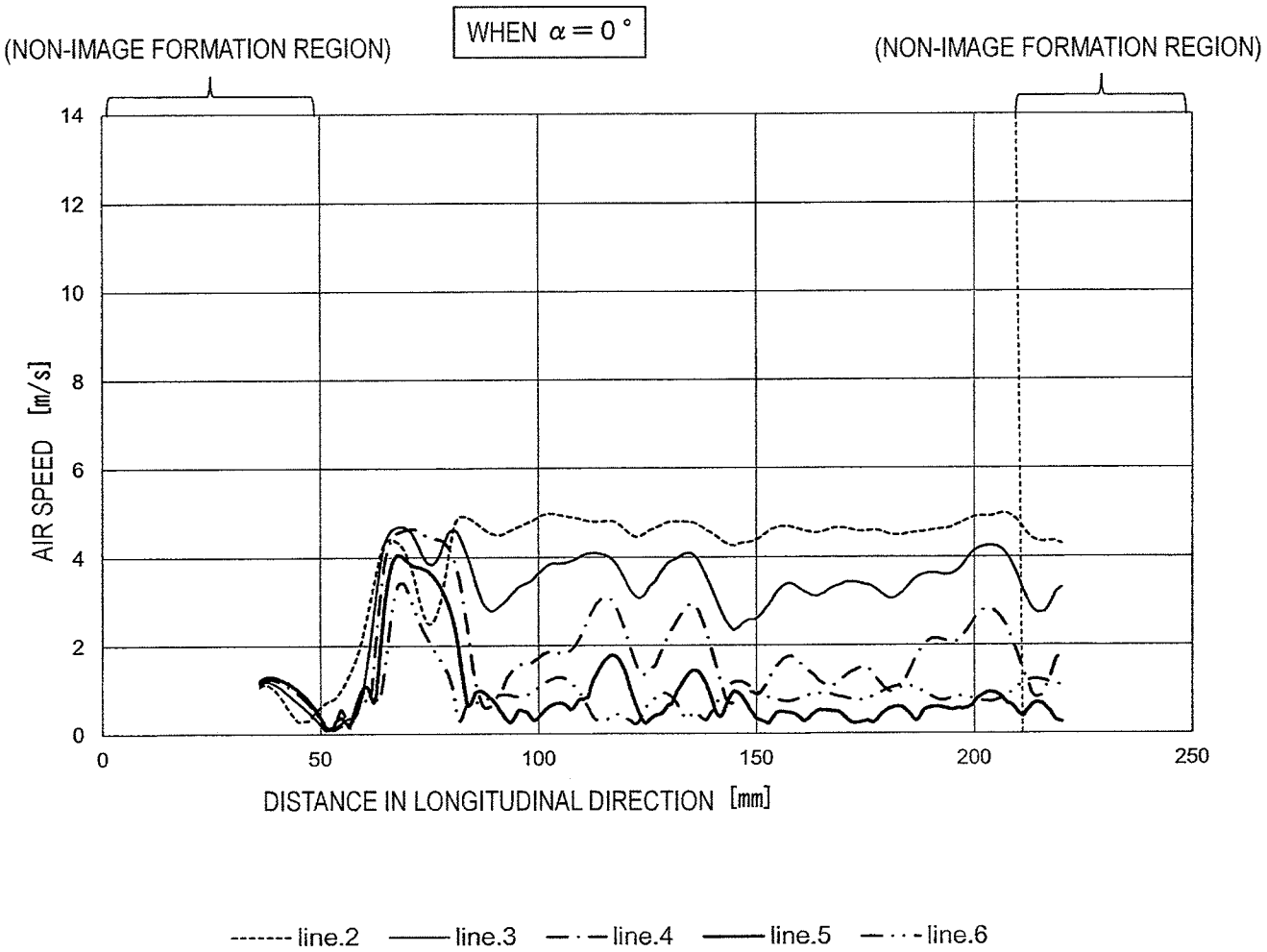
FIG. 12 is a graph illustrating a result of testing a blowing tube of a comparative example.

A test result of the comparative example is illustrated in FIG. 12.

It is ascertained from the result illustrated in FIG. 12 that the air speeds of air output from the outlet port 53 of the blowing duct of the comparative example (in which the inclination angle α of the air hole 71 is 0°) have a small variation in the longitudinal direction B. Particularly, in the comparative example, it is ascertained that the air speed slows down close to zero in one side of an image formation region interposed between non-image formation regions in both end portion of the surface of the photoconductor drum 21, that is, a substantial variation occurs.

In contrast, in the blowing ducts 51A (particularly, when the inclination angle α of the air hole 71 is 1° and 2°), it is ascertained from the results illustrated in FIGS. 13 and 14 that the air speeds of air from the air holes 71 in any line have a small variation and are substantially uniform in the longitudinal direction B. In the blowing ducts 51A of the example, it is ascertained that an error range between the air speeds of air from the air holes 71 disposed from the second line (line 2) to the sixth line (line 6) is 2 m/s in the image formation region, which is good result.

In addition, in the blowing ducts 51A of the example, it is ascertained that the air speed of air from the air holes 71 in any line is higher than that in the blowing duct of the comparative example. The estimated reason for this is that the air (E2) flowing into the third passage space TS3 of the second bent passage portion 54C is likely to enter the air holes 71 of the multi-hole member 70 due to the inclination angle α of the air holes 71 being set to the aforementioned values.

In the blowing duct 51A of the example in which the inclination angle α of the air hole 71 is set to 3°, it is ascertained form the result illustrated in FIG. 15 that the air speed has a small variation in the longitudinal direction B in comparison with that in the other blowing duct 51A of the example (there is no occurrence of a variation by which the air speed extremely slows down on one end side of the image formation region). It is ascertained that an error range between the air speeds of air from the air holes 71 disposed from the second line (line 2) to the sixth line (line 6) is 2 m/s in the image formation region. The estimated reason for this is that if the inclination angle α of the air hole 71 is excessively large, the air (E2) flowing into the third passage space TS3 is more likely to enter the air holes 71, and thus the multi-hole member 70 of the flow control member 62 demonstrates a slightly insufficient rectification function.

It can be said from the test results that the inclination angle α of the air hole 71 is preferably set to a value in a range of "0°<α<3°".

Other Embodiments

In the first exemplary embodiment, each of the plural air holes 71 of the multi-hole member 70 is a through hole, the opening area of which continuously decreases toward the downstream side in the air passing direction J. Alternatively, as illustrated in FIG. 16A, each of the plural air holes 71 may be configured as an air hole (73), the opening area of which stepwisely decreases toward the downstream side in the air passing direction J.

Figure 16A:
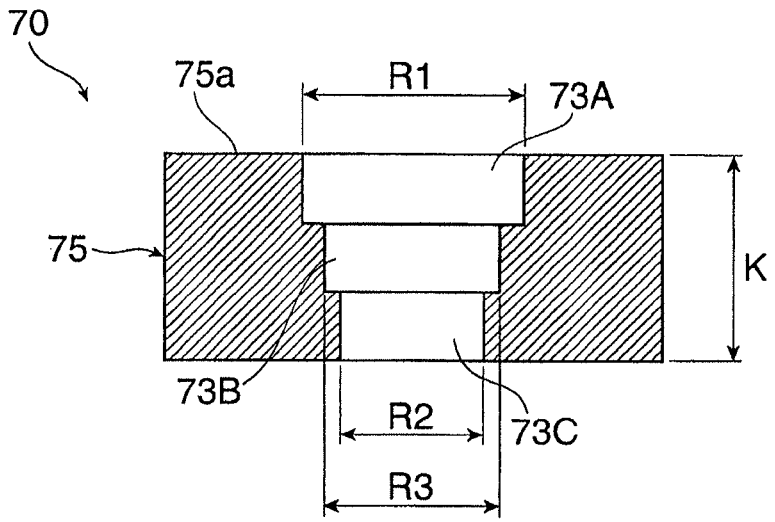
FIGS. 16A and 16B illustrating another configuration example of air holes of a multi-hole member.
Figure 16B:
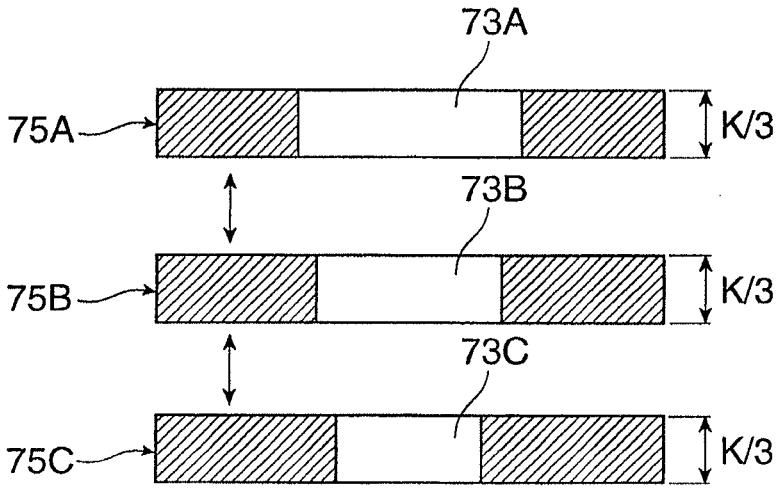

Each of the plural air holes 73 of the multi-hole member 70 illustrated in FIGS. 16A and 16B is configured such that the opening area of the air hole 73 decreases in three steps. Actually, the air hole 73 having a circular opening shape includes a first-step hole portion 73A having the maximum hole diameter R1; a second-step hole portion 73C having the minimum hole diameter R2; and a third-step hole portion 73B having a medium hole diameter R3 (R2<R3<R1).

As illustrated in FIG. 16B, for example, the multi-step air hole 73 is obtained by respectively forming the first-step hole portion 73A, the second-step hole portion 73C, and the third-step hole portion 73B in three separate base plates 75A, 75B, and 75C which form the base plate 75 of the multi-hole member 70 and each of which has one third (for example, one third of K, that is, K/3) of the thickness of the base plate 75, and by integrally superimposing the three separate base plates 75A, 75B, and 75C with respect to the central point of the air hole 73.

The multi-step air hole 73 may be a through hole formed in two steps, or a through hole formed in four or more steps.

Figure 17A:
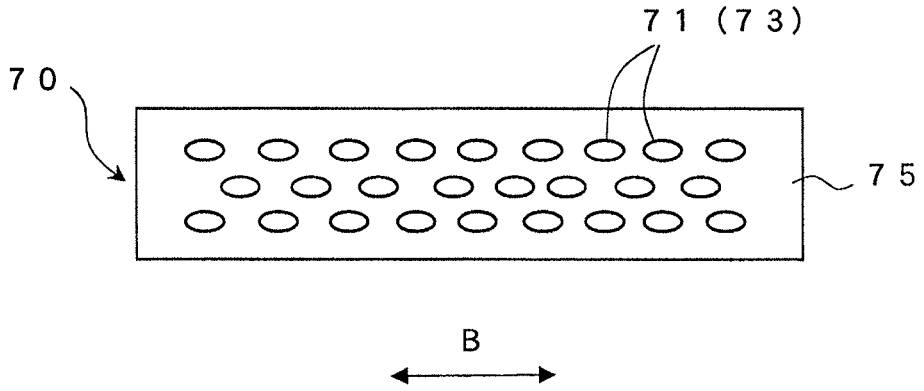
FIGS. 17A and 17B illustrating still another configuration example of air holes of a multi-hole member.
Figure 17B:
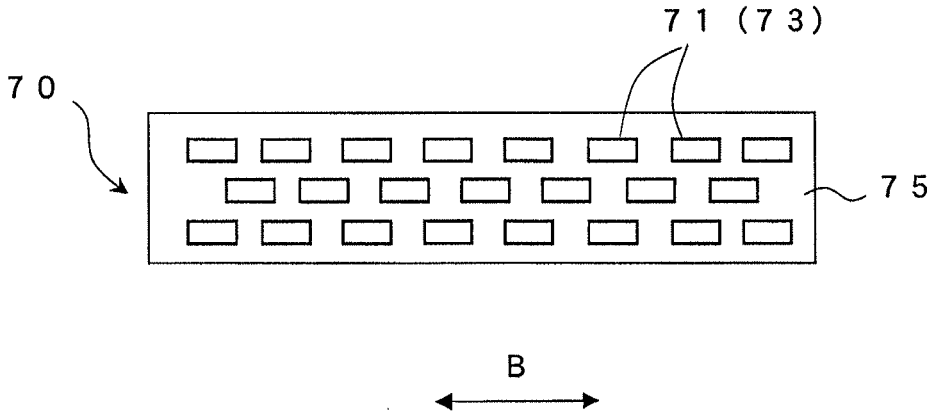

In the first exemplary embodiment, each of the plural air holes 71 (73) of the multi-hole member 70 is a through hole having a circular opening shape. Alternatively, as illustrated in FIGS. 17A and 17B, each of the plural air holes 71 (73) of the multi-hole member 70 may be a through hole, the opening shape of which is a shape (for example, elliptical shape, rectangular shape, or rhombus shape) other than a circular shape. The air hole 71 (73) illustrated in FIG. 17A is configured as a through hole having an elliptical opening shape. The air hole 71 (73) illustrated in FIG. 17B is configured as a through hole having a rectangular opening shape.

The air holes 71 (73) having an opening shape which is long in one direction as illustrated in FIGS. 17A and 17B are preferably disposed such that longitudinal directions of all of the holes are aligned with the longitudinal direction B of the outlet port 53. The air speed of air output from the air holes 71 (73) disposed in this manner is likely to have a smaller variation, and is likely to be more uniform in the longitudinal direction B.

In the first exemplary embodiment, the plural air holes 71 (73) of the multi-hole member 70 are configured to have the same opening area (particularly, opening area of the opening end portion 71*b* of the inner surface 75*a* of the base material 75) or the same hole diameter. Alternatively, the plural air holes 71 (73) may adopt a configuration in which the opening areas or the hole diameters are set to different values according to locations. In this case, among the plural air holes 71 (73) of the multi-hole member 70 of the downstream-most flow control member 62 or in the outlet port 53, the opening areas or the hole diameters of the air holes 71 (73), which are disposed in a region which air is unlikely to enter, are preferably set to be relatively larger than the opening areas or the hole diameters of the air holes 71 (73) disposed in other regions. In this configuration, the air speed of air output from all of the air holes 71 (73) disposed in the multi-hole member 70 is likely to have a smaller variation and is likely to be uniform in its entirety.

In the first exemplary embodiment, the blowing duct 51A is configured as a blowing duct including a passage portion (passage portion shaped to include the inlet passage portion 54A, the first bent passage portion 54B, and the second bent passage portion 54C) 54 which is formed such that the passage space TS is bent two times in the middle of the passage space TS. Alternatively, as illustrated in FIG. 18, a blowing duct 51B may be configured as a blowing duct including the passage portion (passage portion shaped to include the inlet passage portion 54A and a fourth bent passage portion 54D) 54 which is formed such that the passage space TS is bent one time in the middle of the passage space TS.

Figure 18:
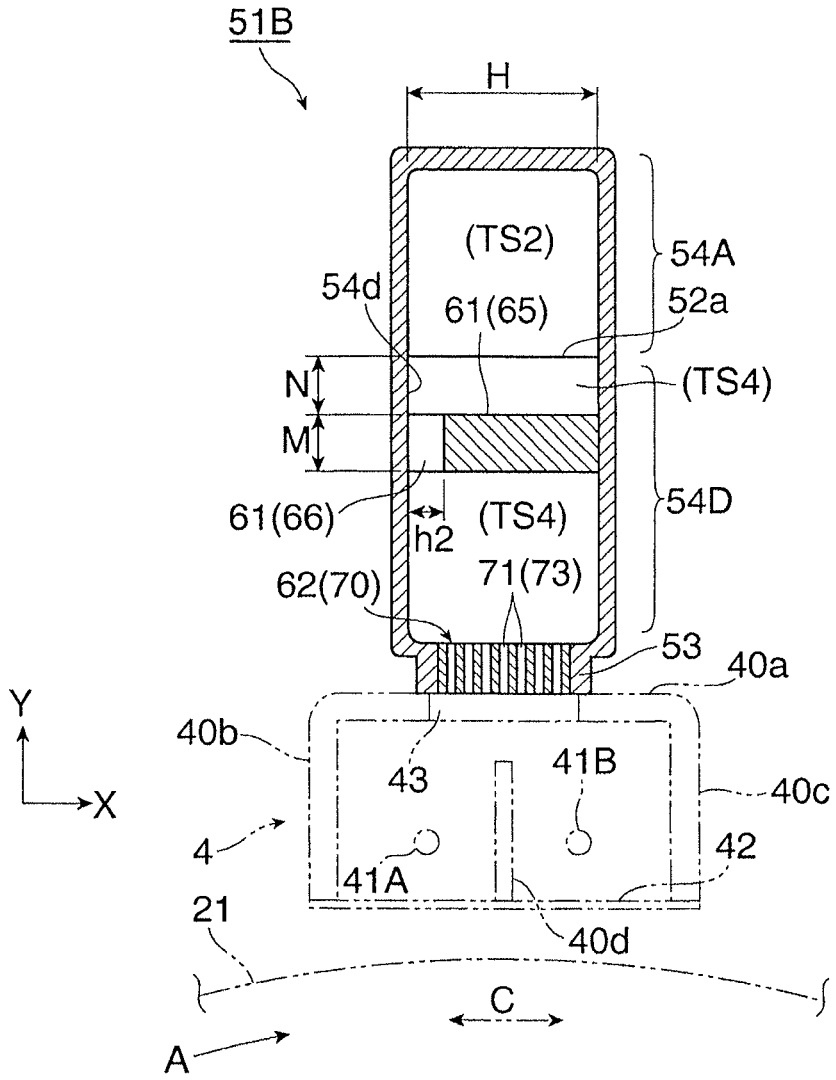
FIG. 18 is a sectional view illustrating another configuration example of the blowing tube.

Similar to the blowing duct 51A of the first exemplary embodiment, the blowing duct 51B illustrated in FIG. 18 includes a passage space TS4 that is bent from the middle of the inlet passage portion 54A at substantially the right angle in the horizontal direction, and then extends straight. The blowing duct 51B includes the fourth bent passage portion 54D having a shape in which the outlet port 53 is present at a trailing end (surface) of the fourth bent passage portion 54D.

Similar to the first flow control member 61 of the first exemplary embodiment (refer to FIGS. 4 and 7), a flow control member structured to include the blocking portion 65 and one air passage portion 66 is provided as the first flow control member 61. Conditions such as the distance N to the position of the blocking portion 65 may be the same as or different from those of the blocking portion 65 of the first exemplary embodiment. Conditions such as the length M or the height h1 of the air passage portion 66 may also be the same as or different from those of the air passage portion 66 of the first exemplary embodiment.

In the blowing duct 51B, the downstream-most flow control member 62 configured as the multi-hole member 70 having the same configuration as that of the first exemplary embodiment is provided in the outlet port 53 present at the trailing end of the fourth bent passage portion 54D.

In the first exemplary embodiment and the like, the two flow control members 61 and 62 are provided as plural flow control members in the blowing duct 51A or 51B of the blowing device 5. Alternatively, three or more flow control members may be provided. Preferably, a flow control member apart from the downstream-most flow control member 62 provided in the outlet port 53 is provided in a portion of the passage space TS of the passage portion 54 of the duct 51, the sectional shape of which is changed, or is provided in a portion of the passage space TS which is positioned after (immediately after) the airflow direction is changed.

The charging device 4 to which the blowing device 5 is applied may be a charging device in which the grid electrode 42 is not installed, that is, a so-called corotron charging device. The charging device 4 may include one corona discharge wire 41, or may include three or more corona discharge wires 41. A target structure to which the blowing device 5 is applied may be configured as a corona discharger that eliminates a charge of the photoconductor drum 21 or the like, may be a corona discharger that charges or eliminates a charge of a charged body other than the photoconductor drum 21, or may be a long structure which is configured as a device other than a corona discharger and requires air blowing from the blowing device 5.

Insofar as a long target structure to which the blowing device 5 is required to be applied is installed in the image forming apparatus 1, a configuration regarding an image forming method or the like is not limited to a specific configuration. In the image forming apparatus 1 of the first exemplary embodiment, one image forming unit 20 is used to form a monochromatic image. Alternatively, an image forming apparatus may be configured such that the plural image forming units 20 forming different color images are used to form multiple color images. If necessary, an image forming apparatus may adopt an image forming method by which an image formed of a material other than a developer is formed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A blowing tube comprising:

a passage portion that includes a passage space through which an inlet port taking in air is connected to an outlet port that outputs the air taken in by the inlet port and has an opening shape which is long in one direction, and through which air flows; and a plurality of flow control members that are provided in portions of the passage space of the passage portion which are positioned at different positions in an airflow direction, and that control a flow of air, wherein one of the plurality of flow control members is provided as a downstream-most flow control member such that the outlet port is blocked by a multi-hole member having a plurality of air holes, and wherein each of the plurality of air holes of the downstream-most flow control member is configured as a through hole consisting of hole portions each having an opening area which is identical in an air passing direction, the hole portions being aligned such that the opening area of the through hole decreases stepwisely toward the downstream side in the air passing direction.

2. A blowing device comprising:

an air blower that delivers air; and the blowing tube according to claim 1 that takes in air delivered from the air blower.

3. An image forming apparatus comprising:

an image forming unit that forms an image; and a blowing device that blows air to a target structure, wherein the blowing device is configured as the blowing device according to claim 2.

4. The image forming apparatus according to claim 3, wherein the target structure is a corona discharger which is long in the one direction.

* * * * *